United States Patent [19]

Fischer

[11] 4,320,644

[45] Mar. 23, 1982

[54] METHOD AND APPARATUS FOR MANUFACTURE OF A VESSEL

[76] Inventor: Karl Fischer, Am Gaensberg, 7519 Oberderdingen, Fed. Rep. of Germany

[21] Appl. No.: 102,692

[22] Filed: Dec. 12, 1979

[30] Foreign Application Priority Data

Dec. 14, 1978 [DE] Fed. Rep. of Germany ..... 2853957

[51] Int. Cl.[3] ..... B21D 22/16

[52] U.S. Cl. ..... 72/75; 72/82; 72/96

[58] Field of Search ..... 72/68, 75, 96, 78, 82, 72/83, 84, 85, 126, 347; 113/120 H, 120 CC

[56] References Cited

U.S. PATENT DOCUMENTS

| | | | |
|---|---|---|---|
| 369,290 | 8/1887 | Kennedy | 72/75 |
| 1,728,033 | 9/1929 | Blake et al. | 72/68 |
| 2,124,961 | 7/1938 | Brinkman | 72/75 |
| 2,160,975 | 6/1939 | Matter et al. | 113/120 H |
| 2,573,736 | 11/1951 | Scavullo | 72/82 |

FOREIGN PATENT DOCUMENTS

| | | | |
|---|---|---|---|
| 368522 | 3/1932 | United Kingdom | 72/68 |

*Primary Examiner*—Lowell A. Larson
*Attorney, Agent, or Firm*—Steele, Gould & Fried

[57] ABSTRACT

Method and manufacture for the manufacture of a cooking vessel with a flat, thick-walled bottom and a substantially thinner casing surface, a cup-shaped blank is shaped in the casing area by a rolling process on a substantially cylindrical, rotary mould part. The rolling tool comprises a rigid outer ring and numerous freely rotatable balls revolving in a groove. The area close to the bottom of the mould part is tapered, so that a cavity is formed into which the material can be shaped in the area close to the bottom.

16 Claims, 6 Drawing Figures

FIG. 3
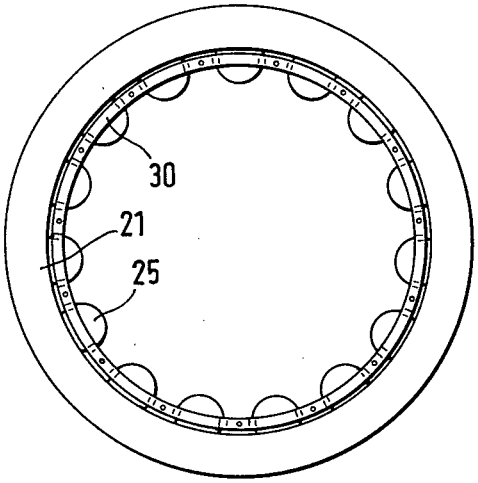
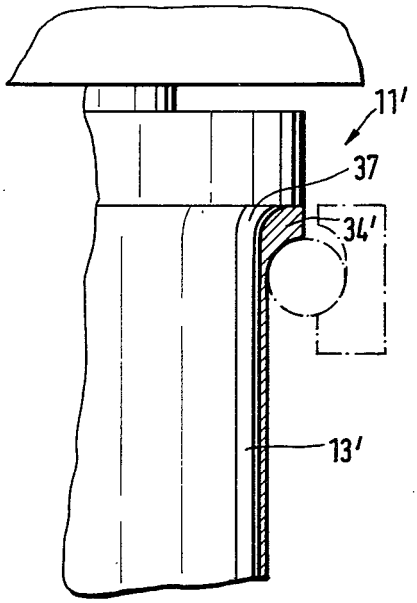
FIG. 6
FIG. 4
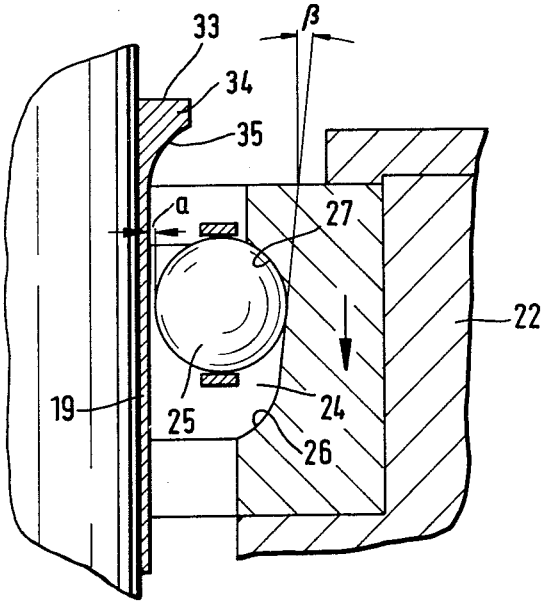
FIG. 5
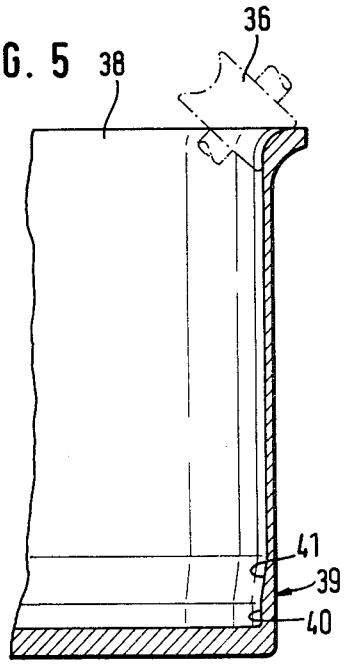

METHOD AND APPARATUS FOR MANUFACTURE OF A VESSEL

BACKGROUND OF THE INVENTION

The present invention relates to a method and to an apparatus for manufacturing a vessel, with a substantially cylindrical casing, which at the bottom passes into a base constructed in one piece therewith.

U.S. Pat. No. 3,556,032 describes a method permitting manufacturing by a rolling process of a very thin-walled container with a curved bottom. For this purpose, an arrangement of four balls is used, said balls facing one another in pairs and being spring-mounted in the radial direction. The balls are located in spherical segments so that they are not peripherally rotated when the rolling process is started by rotating a central male die accompanied by the simultaneous axial movement of the rolling or curling tool. The bottom is also worked by a rolling tool provided around the edges between the bottom and the casing. The wall thickness is somewhat greater in this area than in the remainder of the casing. It is not possible with this method and this apparatus to manufacture cooking vessels with a thick-walled, and in particular completely flat bottom from very hard materials, such as stainless steel.

Methods are also known for the manufacture of vessels, particularly cooking vessels, from aluminium, in which the casing is shaped by a rolling process using pressure rollers and its wall thickness is reduced (German Pat. No. 508,658, U.S. Pat. No. 2,160,975).

German Pat. Nos. 879,797, DOS 2,452,374 and Swiss Pat. No. 297,494 disclose the deep drawing of such vessels. According to DOS 1,652,630, the upper edge of the casing can be flanged by a rolling process.

All the above-described methods do not give satisfactory results. In most methods, it is in particular necessary to re-turn the bottom of the cooking vessel, because the latter is not sufficiently flat. Surface machining is also generally subsequently necessary, particularly in the case of deep drawn products in order to remove machining marks. The flatness of the bottom of is of the greatest importance for a good heat transfer between the electrical hotplate and the cooking vessel and consequently for the efficiency of the cooking process.

SUMMARY OF THE INVENTION

The object of the invention is to provide an improved method and improved apparatus for manufacturing a cooking vessel with a flat bottom, with a minimum of subsequent machining.

According to the invention, this object is achieved in that a stainless steel vessel serving as a cooking vessel with a flat bottom, may be shaped by a large number (more than 4) of balls which are rotatable, but are immovable in the radial direction.

According to the invention, the apparatus suitable for solving the problem has a mould part with substantially cylindrical mould faces and rolling or curling tools with balls associated therewith, said balls being rotatable relative to one another and axially movable, wherein the rolling tool comprises a rigid outer ring with a circulating groove in which are arranged a large number (more than 4) of balls which revolve and rotate about themselves.

The manufacture of the casing, which is substantially thinner than the blank and therefore the bottom, preferably takes place in a single operation without any intermediate heat treatment.

Acccording to a particularly preferred embodiment of the method of the invention, the bottom of the vessel is made planar and smooth in that prior to the rolling-stretching of the casing the part of the material forming the casing and adjacent to the bottom part is radially inwardly deformed by means of the balls, preferably in a cavity formed between the mould part and the blank. Thus, there is a cavity between the blank and the mould part in the section adjacent to the bottom. If the rolling process starts from the bottom, the complete radial rolling pressure is not immediately exerted, whereby this could expose the bottom to compression and consequently to an outward bulging. In fact, there is firstly a radially inwardly directed deformation into the cavity, followed by rolling-stretching with the full degree of stretching.

The invention is described in greater detail hereinafter relative to non-limitative embodiments and with reference to the attached drawings, wherein:

FIG. 3 is a plan view of the rolling tool.

FIG. 4 is a detail of the rolling tool during its return movement.

FIG. 5 is a part of the completely rolled vessel on re-working.

FIG. 6 is a detail of a variant of a rolling tool and the vessel rolled on it.

DETAILED DESCRIPTION OF THE PREFERRED EMBODIMENTS

Figure 1:
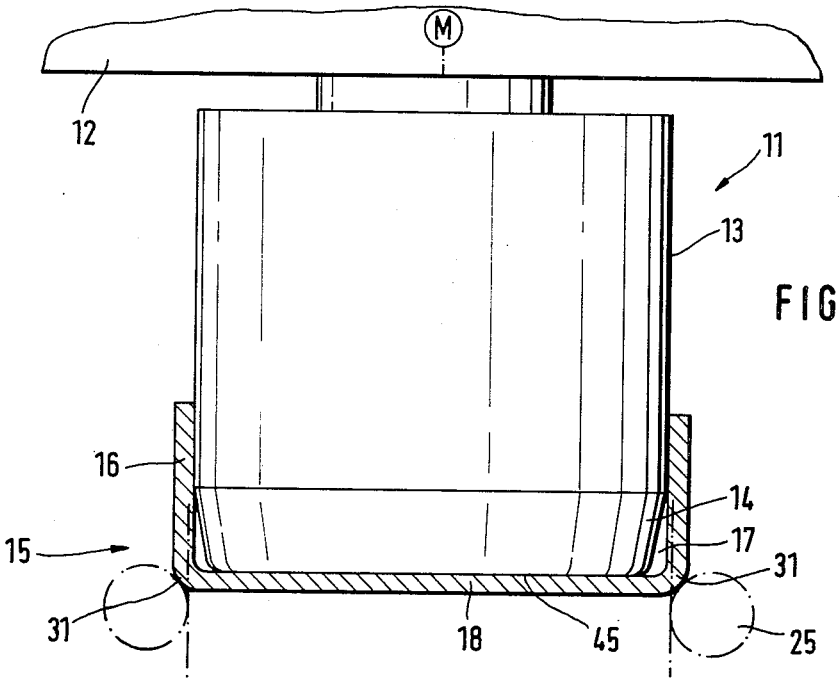
FIG. 1 is a part sectional side view of a mould part and a blank for the manufacture of the vessel.

FIG. 1 shows a mould part or mandrel 11 in the form of a substantially cylindrical male die, which is driven in rotary manner by a moulding machine 12. The surface of mould part 11 forms a mould surface comprising a cylindrical portion 13 and a slightly conical portion 14 in the vicinity of the end face 15 of the mould part. For purposes of clarity, the size and conicity of the frustum-shaped portion 14 are shown in an exaggerated manner. Mould part or mandrel 11 is made from a very hard material and mould faces 13, 14 are burnished and optionally chromium plated.

A cup-shaped blank 15, made from a plate of stainless steel and which is preferably 2 to 4 mm thick, is placed on mould part 11. The internal diameter of the cylindrical casing 16 of the blank corresponds to the external diameter of the cylindrical mould face portion 13, which extends into the latter. Between the casing inner surface and the conical mould face portion 14, a cavity 17 is formed. The flat bottom 18 of the blank 15, made by a drawing or hobbing process from a plate, engages on the planar end face 45 of mould part 11. Casing 16 has approximately the same wall thickness as bottom 18.

Figure 2:
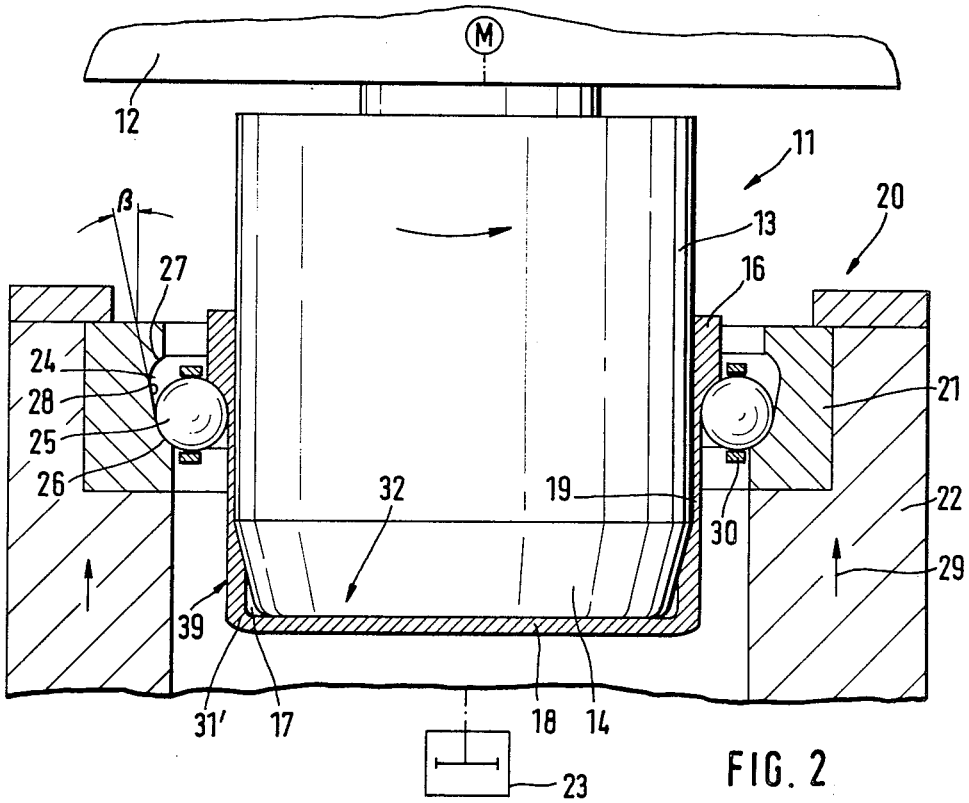
FIG. 2 is a view in accordance with FIG. 1 with the rolling tool during the rolling process.

FIG. 2 shows the rolling process which considerably reduces the wall thickness of casing 16 of the blank, so that a cooking vessel with a high-thin-walled surface 19 is formed from the flat member. Rolling is carried out with a rolling tool 20, which is similar to a heavy ball bearing which, without an inner ring, is placed from the bottom side onto the blank located on mould part 11, accompanied by the rotation and simultaneous axial advance. It has an outer ring 21, which is mounted in a thrust ring 22 of moulding machine 12 and can be moved axially over the mould part and then back again by means of a feed mechanism 23, shown diagrammatically by a hydraulic cylinder, but which can also function mechanically. On its inside, outer ring 21 has a circulating groove 20, which is somewhat wider than would correspond to the balls 25 running in it. The lateral surfaces of the groove are formed by rounded shoulders 26, 27, whose radius of curvature corresponds to the balls. The connecting surface 28 between the rounded shoulders 26, 27 is, however, inclined in such a way (at an angle $\beta$), that the groove at rounded shoulder 26, which is at the rear in the feed direction 29, is narrower than at rounded shoulder 27.

As can be gathered from FIG. 3, a large number of balls 25 (e.g. 15) is provided, guided by a cage 30. Compared with a normal ball bearing, the groove 24 is particularly deep in the area of the rounded shoulder 26 which is loaded during the rollng process and, to the extent permitted by cage 30, extends into the central area of the balls. However, the boundary wall in the vicinity of rounded shoulder 27 need not be so deep. The slope of the connecting surface 28 is shown in exaggerated form for clarity. It is sufficient if the balls have some axial play in groove 24 and can be outwardly displaced by a few tenths of a millimeter. The transition can also be stepped.

The rolling process takes place in the following manner. If the rolling tool 20 is moved from below in FIG. 1 up to the blank rotating with the mould part 11, in the manner shown in broken line form, the balls 25 come into contact with edge 31 between casing 16 and bottom 18. The internal diameter between the balls in their position according to FIG. 2 (working position) is substantially smaller than the external diameter of the blank casing 16, but is thicker by the thickness of the vessel surface 19 than the cylindrical mould face portion 13. At the start of the rolling process, the casing material located in the vicinity of edge 31 is firstly substantially radially forced inwards into cavity 17, so that in this area the forces exerted by the rolling tool are significantly smaller than in the remainder of the rolling process. In particular, there is no significant compression or bulging of bottom 18, so that the latter remains flat. Surprisingly, the bending forces in the vicinity of edge 31 do not bring about any bulging of the bottom.

With increasing diameter of mould part 11, the material stretching produced by the rolling process is constantly increased and the material (flows) from the rolling tool in the upwards direction. It is thereby worked or shaped, is given a great strength and toughness and a compressed, crack-free and bright surface, which normally requires no further polishing. Accompanied by rotation, the balls revolve around themselves and the mould part in its rolling movement in the groove. Due to the large number of balls, which preferably have an uneven number, so that in each case one ball is supported on two facing balls in the form of a "three-point bearing", together with a relatively large circumferential speed of the mould part 11 which rotates with respect to the non-rotary outer ring 21 of the rolling tool, this surface finishing is obtained at the same time as the rolling-stretching process. It is also possible to rotate the rolling tool and/or to axially displace the mould part.

In FIG. 4, vessel 32 is completed, i.e. casing surface 19 is rolled out to its complete height. The rolling process is broken off somewhat below the upper vessel edge 33, so that at this point the complete thickness of the blank material is retained and is optionally even increased by a flange caused by the rolling tool, thereby forming an edge reinforcement 34 with a rolled channel 35.

FIG. 4 also shows that on moving back the rolling toll opposite to the feed direction 29, the balls are moved axially into the groove in such a way that their radial spacing with respect to one another is increased by the amount a and consequently a withdrawal of the rolling tool is possible without any increased contact between balls and casing surface 19. Since, following the rolling process, the surface is somewhat elastically expanded, which also facilitates its removal from the mould part, a contact with the balls would otherwise be necessary and withdrawal would have to take place with further rolling.

On the inner edge of the upper rim, the finished vessel (FIG. 5) can be re-shaped by a rolling tool 36 or by metal cutting in order to create a pouring edge. According to the variant of FIG. 6, it is also possible to provide the mould part 11' with a downwardly directed fillet 37 which follows onto the cylindrical mould face 13' and which during the rolling process forms an inner roundness of the bead 34'. The rolling process is preferably stopped as a function of the bead force in order to avoid too high forces at the end of the rolling process when there are variations in the residual material in the bead 34' due to material tolerances.

In this case, the edge inner roundness 38, like the remaining inner surface of the casing 19, would have an excellent surface quality requiring no polishing and resulting from the highly polished mould faces 13, 14. The shape of the surface area 39 adjacent to the bottom formed with a conical construction of the mould face portion 14 is particularly apparent from FIGS. 2 and 5. Normally, the cavity 17 is not completely filled by material, so that over a radius to the bottom 18 is connected a narrow cylindrical portion 40 and then a conical portion 41. The mould face portion 14 need not be conical and could also be curved or slightly stepped. It could also have the same shape as the vessel in area 39, but it is advantageous for a small part of the cavity 17 to be left over after the rolling process, because it is an expansion chamber which, as a function of the material tolerance and characteristics, ensures that no inadmissible compression forces are exerted on bottom 18 although balls 25 are guided in a rigid and not radially sprung outer ring and as a result the surface characteristics of the casing are uniform over the entire height.

The vessel used as a cooking vessel need subsequently only be provided with handles or grips and can otherwise be used without any further working of the bottom. The relatively thick bottom 18 brings about a good transfer of heat from a flat electric hotplate to the inside of the vessel as a result of its flatness and ensures a uniform heat distribution. Due to the one-piece construction without involving the assembly of parts, the flatness is retained, even in the case of varying heating conditions.

Typical dimensions are:

Thickness of bottom and portion 40: 2 to 3.5 mm
Height of portion 40: 2 mm
Height of area 39 (portions 40 and 41): 5 to 10 mm
Casing thickness: 0.5 to 0.8 mm.

These dimensions can vary upwards or downwards, but preferably by no more than 20% as a function of the size and use of the cooking vessel. With its continuous cylindrical outer surface, the casing extends up to close to the edge 31' between bottom and casing surface 19 and passes with a bend into a gentle fillet to the bottom. The material is preferably chromium steel with a chromium content of 14% to 18% and preferably 16%. The thickness of casing surface 19 is between one third ($\frac{1}{3}$) and one sixth (1/6) of the bottom thickness.

What is claimed is:

1. A method for manufacturing a stainless steel cooking vessel from a cup-shaped blank of stainless steel, the blank having a wall and a bottom, the bottom having a substantially planar bottom surface, comprising the steps of:

positioning the cup-shaped blank on a substantially cylindrical mandrel, the mandrel having an outer diameter corresponding to the finished inner diameter of the wall of the cooking vessel, except for a tapered end portion having a smaller diameter, the tapered portion and the blank defining an annular recess therebetween;

disposing an annular arrangement of at least five individually rotatable balls co-axially with the mandrel, the innermost points of the at least five balls defining the finished outer diameter of the wall of the cooking vessel; and, effecting a one-step rolling process, from the bottom of the cup-shaped blank upwardly, by axially displacing at least one of the mandrel and the annular arrangement of rotatable balls toward one another and rotating at least one of the mandrel and the annular arrangement of rotatable balls relative to the other, whereby the lower portion of the wall defining the annular recess is pressed inwardly and left relatively thick, the upper portion of the wall defining the annular recess is pressed inwardly and progressively made thinner and the remainder of the wall is made substantially and uniformly thinner, all without disrupting the planar bottom surface, so that no further machining operations are required to finish the outer surfaces of the bottom and wall.

2. A method according to claim 1, wherein the one-step rollng process takes place without intermediate heat treatment.

3. A method according to claims 1 or 2, wherein the cup-shaped blank is first produced from a plate-shaped member.

4. A method according to claims 1 or 2, further comprising the step of forming an upper reinforcing edge around the wall of the cooking vessel by terminating the one-step rolling process just beneath the upper edge of the blank.

5. A method according to claim 4, further comprising the step of rolling at least a portion of the inner surface of the upper edge of the vessel in order to form a pouring surface.

6. A method according to claim 1, further comprising the step of fixing the radial position of the individually rotatable balls within the annular arrangement during the one-step rolling process.

7. A method according to claim 6, further comprising the step of moving each of the balls radially outwardly during axial separation of the mandrel and the annular arrangement of rotatable balls.

8. A method according to claim 8, further comprising the step of simultaneously moving the balls in the processing direction, thereby providing a compound inclined movement away from the vessel.

9. An apparatus for manufacturing a stainless steel cooking vessel having a flat bottom and a substantially cylindrical wall, the bottom and the wall being formed integrally from a cup-shaped stainless steel blank, the blank having a substantially planar bottom surface, the apparatus comprising:

a substantially cylindrical mandrel, the mandrel having an outer diameter corresponding to the finished inner diameter of the wall of the cooking vessel, except for a tapered end portion having a smaller diameter, the tapered portion and the blank defining an annular recess therebetween when the blank is placed on the mandrel;

a rolling tool having a rigid outer ring, a circulating groove in the ring and at least five individually rotatable balls disposed in the circulating groove, the rotatable balls defining the finished outer diameter of the vessel; and, means for axially displacing at least one of the mandrel and the rolling tool toward one another and for rotating at least one of the mandrel and the rolling tool relative to the other, whereby a one-step rolling process is effected from the bottom of the cup-shaped blank upwardly, the lower portion of the wall defining the annular recess being pressed inwardly and left relatively thick, the upper portion of the wall defining the annular recess being pressed inwardly and progressively made thinner and the remainder of the wall being made substantially and uniformly thinner, all without disrupting the planar of the bottom surface, so that no further machining operations are required to finish the outer surfaces of the bottom and wall.

10. An apparatus according to claim 9, further comprising a ball bearing cage for guiding the balls in the circulating groove.

11. An apparatus according to claims 9 or 10, wherein the tapered portion of the mandrel extends over an axial length in the range of 5 mm to 12 mm.

12. An apparatus according to claim 11, wherein the tapered portion of the mandrel is conical, having a diameter at its end-most portion which is at least 2 mm less than the substantially uniform cylindrical portion of the mandrel.

13. An apparatus according to claims 9 or 10, wherein the circulating groove is axially longer than the diameter of the balls, permitting an axial displacement thereof, and wherein one axial end of the groove has a smaller diameter than the opposite axial end of the groove, whereby the balls are automatically radially fixed in a working position in the smaller diameter portion of the groove during the rolling process and are automatically displaced into a removal position in the larger diameter portion of the groove during separation of the mandrel and the rolling tool.

14. An apparatus according to claim 13, wherein the inner diameter of the outer ring adjacent the working position of the groove is smaller than the inner diameter of the outer ring adjacent the removal position of the groove.

15. An apparatus according to claims 9 or 10, wherein the rolling tool has an odd number of balls.

16. An apparatus according to claim 15, wherein the balls are spaced at substantially equal circumferential intervals, providing a plurality of balanced "three-point" contacts.

* * * * *

UNITED STATES PATENT AND TRADEMARK OFFICE

CERTIFICATE OF CORRECTION

PATENT NO. : 4,320,644

DATED : March 23, 1982

INVENTOR(S) : Karl Fischer

It is certified that error appears in the above-identified patent and that said Letters Patent are hereby corrected as shown below:

Column 1, line 42, after "bottom" delete "of".

Column 5, line 64, "8" should be --7--.

Column 6, line 31, after "planar" delete "of the".

Signed and Sealed this

*Twenty-second* Day of *June 1982*

[SEAL]

*Attest:*

GERALD J. MOSSINGHOFF

*Attesting Officer*

*Commissioner of Patents and Trademarks*